US010065446B1

(12) United States Patent
Halfen et al.

(10) Patent No.: US 10,065,446 B1
(45) Date of Patent: Sep. 4, 2018

(54) USER SELECTABLE FILE TAB SYSTEM AND METHOD

(71) Applicant: Smead Manufacturing Company, Hastings, MN (US)

(72) Inventors: Marvin J. Halfen, Hastings, MN (US); Dennis Bowen, Ellsworth, WI (US); Anthony Kramer, Woodbury, MN (US)

(73) Assignee: Smead Manufacturing Company, Hastings, MN (US)

( * ) Notice: Subject to any disclaimer, the term of this patent is extended or adjusted under 35 U.S.C. 154(b) by 45 days.

(21) Appl. No.: 15/194,801

(22) Filed: Jun. 28, 2016

Related U.S. Application Data

(60) Provisional application No. 62/185,884, filed on Jun. 29, 2015.

(51) Int. Cl.

| | |
|---|---|
| ***B65D 27/00*** | (2006.01) |
| ***B42F 7/02*** | (2006.01) |
| ***B42F 21/02*** | (2006.01) |
| ***B42F 21/06*** | (2006.01) |

(52) U.S. Cl.
CPC ..... *B42F 21/06* (2013.01); *B42F 7/02* (2013.01)

(58) Field of Classification Search
CPC .... B42F 21/06; B42F 7/02; B42F 7/08; B42F 21/02; B42F 21/00; B42F 21/04
USPC ..... 229/67.1, 67.3, 67.2, 67.4, 928; 40/359, 40/641
See application file for complete search history.

(56) References Cited

U.S. PATENT DOCUMENTS

| | | | | |
|---|---|---|---|---|
| 5,720,427 | A | 2/1998 | Kachel et al. | |
| 6,273,470 | B1 | 8/2001 | Bullock | |
| 7,850,062 | B2 | 12/2010 | Christensen et al. | |
| 7,980,014 | B2 | 7/2011 | Fasbender | |
| 8,443,534 | B2 * | 5/2013 | Goodfellow | B65D 27/00 116/321 |
| 8,550,330 | B2 | 10/2013 | Black et al. | |
| 8,746,539 | B2 | 6/2014 | Dodson | |
| 9,114,661 | B2 * | 8/2015 | Dobson | B42F 15/00 |
| 9,586,432 | B2 * | 3/2017 | Black | B42F 21/025 |
| 2011/0215135 | A1 * | 9/2011 | Goodfellow | B65D 27/00 229/67.1 |
| 2015/0041526 | A1 * | 2/2015 | Busam | B42D 1/06 229/67.1 |

* cited by examiner

*Primary Examiner* — Christopher Demeree
(74) *Attorney, Agent, or Firm* — Altera Law Group, LLC

(57) ABSTRACT

A folder and method of making a panel with a plurality of foldable tab extensions. The extensions include first and second regions extending away from the panel, and having scored fold lines therebetween. The uppermost tab region has a releasable adhesive as does a portion of the panel. The panel has a releasable coating or surface such when the tab extensions are folded, either at the first or second region along the fold lines, adhesive on the second region will mate with surface on the panel. To reduce memory effect at the fold, the score lines can be triple scored by parallel two or three parallel score lines. The central score line can be shallower than the parallel scores on either side thereof.

17 Claims, 11 Drawing Sheets

USER SELECTABLE FILE TAB SYSTEM AND METHOD

INCORPORATION BY REFERENCE

This application hereby incorporates the following patent disclosures by reference in their entirety the following patents: U.S. Pat. No. 5,720,427 to Katchel et al., Reinforced Expanding Folders; U.S. Pat. No. 6,273,470 to Bullock, Slip Resistant File Folders; U.S. Pat. No. 8,746,539 to Dodson, Visually Enhanced Tab File System; U.S. Pat. No. 8,550,330 to Black et al., Integrated Tab Hanging File System; U.S. Pat. No. 7,980,014 to Fasbender, Three Dimensional Tab System; U.S. Pat. No. 7,850,062 Christensen et al., Integrated Tab File System.

FIELD OF THE INVENTION

The present invention is directed to a file system which has spaced apart tabs which can be raised and lowered according to user preference. It may be applied to file folders, other office requisites or any use where user selectable indicators are advantageous.

BACKGROUND

File folders, hanging file folders and other paper storage systems are of great utility in an office setting. The most common storage system, the common manila folder, for example are widespread and relatively inexpensive, and have convenient tabs suitable for writing.

In order to know what is in the file folder, it is useful to have protruding tabs such as shown in U.S. Pat. No. 8,746,539. It is commonly known to manufacture folders with tabs located at different locations across the top edge of the folder. That makes it possible for the user to see adjacent/back to back folder because the adjacent tabs are laterally offset. The problem with this solution is a) it requires the use and manufacture of multiple folders with tabs appropriately offset and b) if the user rearranges the folders, the tab offset may no longer be correct (it may be occluded by an adjacent folder) and thus require the user to change out the folder.

Solving this problem also involves creating a tab system which is robust enough to a) be reusable without damage and b) remain flat enough that the tab is easily readable at the desire angle.

SUMMARY

The following a summary intended to assist the reader in understanding some aspects of the disclosure. It does not define the scope of the invention. Please refer to the claims for that.

The present disclosure relates to a product and process of making a tab integral to the folder (or other container) which makes it possible to raise/reveal a tab at the desired lateral location and then to return that tab to a lowered/out of line of sight position. In addition the tab must be easily viewable at the desired user angle.

By creating user selectable tabs, the manufacturer can provide one folder for all tab positions (such as center, left, right) and have the user decide which ones to liberate from the leaves from which they are formed. Two or three dimensional tabs are also possible. There is also disclosed a file folder having front rear and bottom walls having a front panel having a top and bottom edge, a rear panel having a top and bottom edge, a bottom panel joining said front and rear panels, a fold over cover portion extending from said top edge of the rear panel and capable overlying a portion of the front panel and forming at least a partial top to the folder, and a tab shaped user separable portion in said cover portion configured to allow a user to release the tab shaped portion from the cover portion thereby creating a tab extending from said top edge of said rear panel and creating an opening in said cover portion for said tab to protrude therethrough.

Also disclosed is a file folder having first and second leaves with top and bottom edges on each leaf, said leaves being connected at one of each of said edges to form a fold line; and a tab is a separable portion of one of said leaves formed from a portion of one of said leaves, said tab having its base generally along said fold line, and extending away from the leaf from which it was formed, leaving an aperture in that leaf corresponding to that the material freed from said leaf to create said tab.

Also disclosed is a method of making a folder with user selectable tabs which can be repeatedly reused and which have score lines and cut outs to minimize curing of the tab, so that can be oriented orthogonally to the users desired field of view.

Also disclosed is a file folder having user selectable indictor tabs, having a) a front panel having a top and bottom edge,
b) a rear panel having, front face, a top and bottom edge,
c) a bottom panel joining said front and rear panels,
d) a plurality of foldable indicator tabs extending upwardly from the top edge of the rear panel, said tabs including:
   a first region having a front surface, and top and bottom edges, said top edge foldably extended from said top edge;
   a second region having front surface and a top and bottom edges, foldably extended from the top edge of said first region;

said plurality of tabs being adjacent across the top edge of the rear panel;

e) a score folding line between said top edge of said rear panel and the bottom edge of said first region;
f) a score folding line between said top edge of said first region and the bottom edge of said second region;
g) at least a portion of said front surface of second region including an adhesive thereon;
h) at least a portion of said front face of said rear panel being capable of being releasably attached to said adhesive;

so that a user may fold one or more tabs into a user visible position where the second region is folded over the first region and onto at least a portion of the adhesive on said rear panel, whereby that folded tab is at least partly visible over said front panel and where a user may fold the remaining tabs to a visible position or invisible position, said invisible position having said first region folded onto said rear panel.

Also disclosed is a folder wherein a plurality of tabs are breakable joined to each other.

Also disclosed is a folder wherein the plurality of tabs are spaced apart from each other.

Also disclosed is a folder wherein the score folding lines include a plurality of adjacent parallel impressions to remove tension in the fold.

Also disclosed is a folder wherein the score folding lines include a central score line having a generally rounded impression and a pair of adjacent score lines on either side of said central score line which have sharper impressions than said central score line.

Also disclosed is a folder wherein adhesive is on one of the panels and a smooth coat of tape or other releasable surface is on the other.

Also disclosed is a folder wherein the adhesive can be brought together with the surface and can be separated without damage to the second region and read panel.

Also disclosed is a folder wherein the adhesive is low tack with respect separability from each member.

Also disclosed is a folder wherein the adhesive can be separated multiple times without damage to said region and panel.

Also disclosed is a folder wherein the adhesive is a tape.

Also disclosed is a folder wherein the folder is made from a fibrous stock and wherein the fibers generally run in one direction, and wherein said score lines are oriented to generally align with the direction of the fibers to minimize memory effect of at the score lines.

Also disclosed is a folder wherein the plurality of tabs are spaced apart from each other at their side edges and wherein their side edges are tapered away from each other to minimize memory effect.

Also disclosed is a file folder having user selectable indictor tabs, a method of construction having any or all of the following steps in any order:

a) selecting a piece of stock material;
b) cutting the stock material as follows:
  a. creating a unitary pattern of stock material having
    i. a front panel, having a top and bottom edge;
    ii. a rear panel having a bottom edge joined to the bottom edge of said front panel;
    iii. a plurality of foldable indicator tab extensions extending from said top edge, each of said extensions further including a first region adjacent said top edge and second region extending from said first region away from said top edge;
c) scoring fold lines into said stock material as follows:
  a. creating a score folding line between said top edge of said rear panel and said first region;
  b. creating a score folding line between said first and second region;
d) applying a first releasable adhesive to least a portion of second region;
e) applying a releasable surface to at a least a portion of said rear panel, said surface being located such that when said tab extension is folded onto said rear panel either fold line at least part of said first adhesive engages said surface so that a user may fold one or more tab extensions into a user visible position where the second region is folded over the first region and onto at least a portion of the surface on said rear panel, whereby that folded tab extension is at least partly visible over said front panel and where a user may fold the remaining tab extensions to a visible position or invisible position, the invisible position having said first region folded onto said rear panel.

Also disclosed is a folder having a front and back panels made of a substantially planar stock, and foldable indicator tabs extended from the real panel, a method of minimizing memory effect at a fold line when at least one tab folded comprising any or all of the following steps of in any order:

a. defining a place folding line in said stock;
b. impressing first compression recess in said stock along the fold line by a first scoring tool of first predetermined force having a rounded tip;
c. impressing a pair of parallel lines on either side of said fold line but spaced apart therefrom by a second scoring tool of a second predetermined force, said second scoring tool have a tip less rounded and more pointed than said first tool, thereby creating three score lines.

Also disclosed is a method wherein said second scoring tool has a top with an apex.

Also disclosed is a method wherein said second scoring tool applies a greater force per unit area than said first tool.

Also disclosed is a tabbed divider having user selectable indictor tabs, comprising:

a) a panel having, front face, a top and bottom edge,
b) a plurality of foldable indicator tabs extending upwardly from the top edge of the panel, said tabs including:
  a first region having a front surface, and top and bottom edges, said top edge foldably extended from said top edge;
  a second region having front surface and a top and bottom edges, foldably extended from the top edge of said first region;

said plurality of tabs being adjacent across the top edge of the panel;

c) a score folding line between said top edge of said panel and the bottom edge of said first region;
d) a score folding line between said top edge of said first region and the bottom edge of said second region;
e) at least a portion of said front surface of second region including an adhesive thereon;
f) at least a portion of said front face of said panel including a releasable material thereon;

so that a user may fold one or more tabs into a user visible position where the second region is folded over the first region and onto at least a portion of the adhesive on said panel, whereby that folded tab is at least partly visible and where a user may fold the remaining tabs to a visible position or invisible position, said invisible position having said first region folded onto said panel.

The present invention has many facets and only a few are set forth in this summary. Reference should be had to the detailed description and the claims for a full definition of the invention.

DETAILED DESCRIPTION

The present disclosure is directed to an integrated tab system for a folder. The tabs may be 2 or 3 dimensional, i.e., they may be flat or have their display faces at an angle with respect to the plane of the folder. The term folder, wallet or wallet type folder, is intended to encompass a range of office requisites, such as binders, folios, classification folders, expanding files and similar items including containers, which could benefit from an integral tab for receiving marking/indicia and which hereto for, have not had such an integral feature. Integral or unitary is meant to mean that the tab is part of the wallet or folder and that the tab does not have to be user-attached. It can also mean that the tab is formed directly in the existing material, and does not require an attachment, but that is only the preferred embodiment.

A tabbed folder can be a hanging type with suspension hooks, plain or any other formulation of a pair of substantially planar sidewalls, with one sidewall taller than the other thereby forming a tab which may receive indicia. The tabs may be 2 or 3 dimensional.

Figure 1:
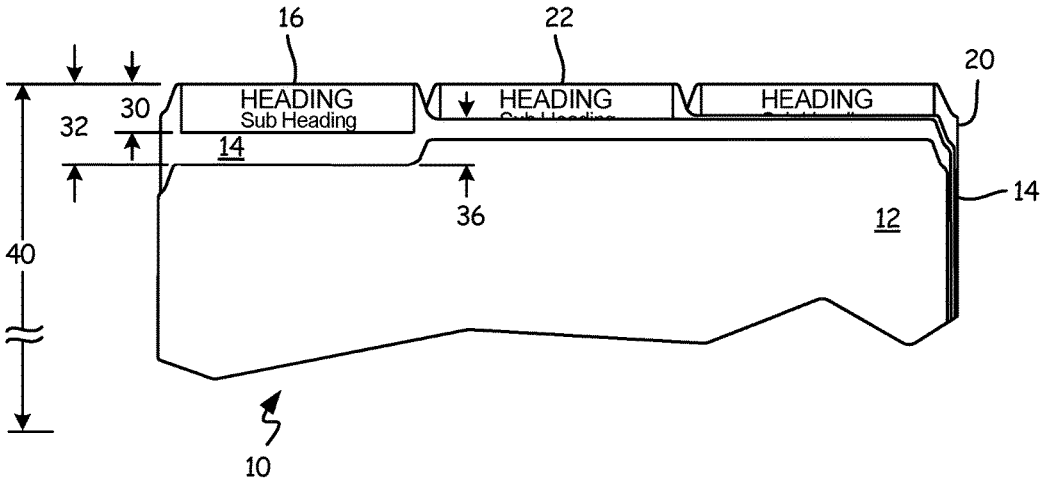
FIG. 1 is a plan view of three folders having offset tabs (in this case three across) laterally spaced so that the entire upwardly extending tab will not be occluded by the tab on the adjacent folder.

FIG. 1 illustrates a typical file folder 10 of the simplest kind. Behind it are two additional folders 20 and 22, each of which have visible tabs. This configuration is a three tab cut where three tabs are sequentially offset so that the three tabs can be seen at once. Of course, there can be more or fewer than three tabs. The position of the tabs relative to each other is important so that the viewing of the tab is not occluded.

Side tab or other versions of the folder are also within the scope of this invention. Likewise, as mentioned above, the term folder encompasses any other structure which could include tabs even if it would not normally be considered a folder. A multi-ring binder with a tabbed panel would be such an example. Folder 10 has front substantially planar face 12 and a rear face 14. In this case they are joined at the bottom (not shown) though they may also be joined at either side. The tab 16 has, in this case a label affixed thereon as a way to display the indicia. The visibility of the tab depends on height 30 which is the height of the tab, but more importantly the height of the tab is limited by height 32 which is the depth to which the front face 12 is cut to expose the tab face 16. The full height of the folder from the top of the tab to the bottom of the folder (not visible) is identified schematically by numeral 40. It is a length equal to or less than the allowed height for by standardized file cabinets. This height 40 cannot be changed without creating problems with existing standards. Dimension 36 is the distance from the bottom of the lowest cut on the front panel 12 to the highest level/edge on the same panel as measured from the bottom of the panel.

Figure 2:
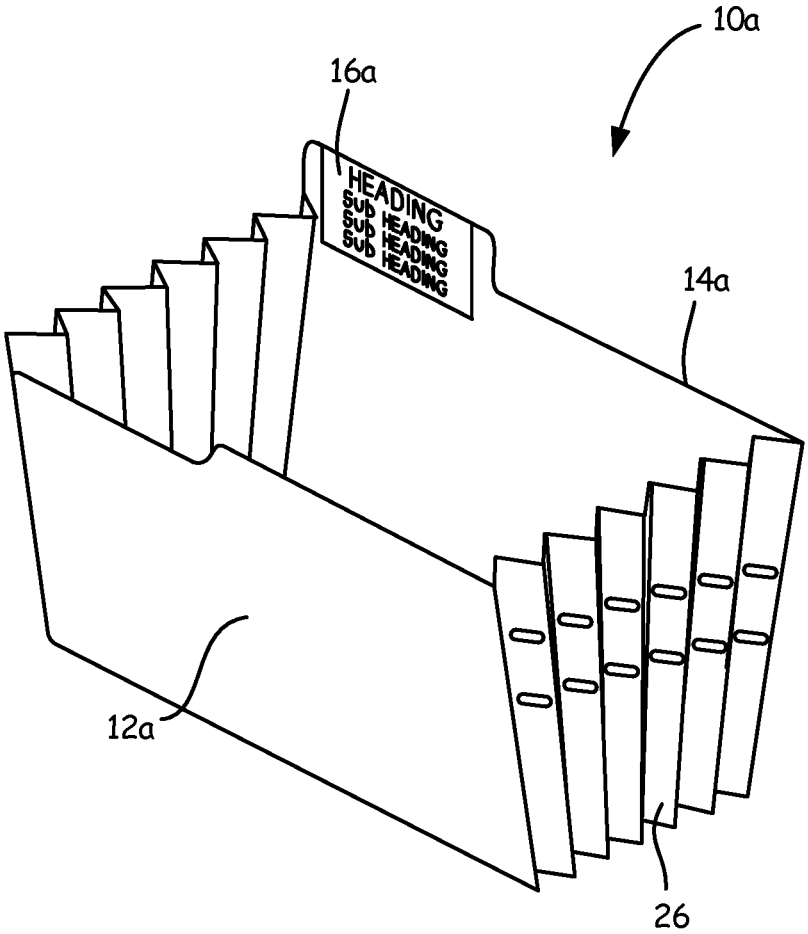
FIG. 2 is a perspective view of a pocket folder with a tab.

FIG. 2 illustrates a typical expanding pocket, or pocket folder which may also be constructed according to this disclosure. A typical wallet like expanding folder, such as the expanding file 10*a* is shown in FIG. 2. In this embodiment, it has front and rear faces 12*a*, 14*a* and has top and bottom ends. The front and rear faces are joined by sidewalls 26. In the preferred embodiment, the side and bottom walls are a unitary piece folder twice and have an accordion fold/pleat for expansion. Elastic materials, such as latex could also be used for the expansion section, and of course, it does not have to provide expansion at all.

FIGS. 3-9 illustrate folders with the additional features of being selectable. It is understood that this concept may be applied to any form of folder, divider or tab indicator. This document will refer to all of these product types as "folders" merely for simplicity, but the broader use of this concept is intended.

Figure 3:
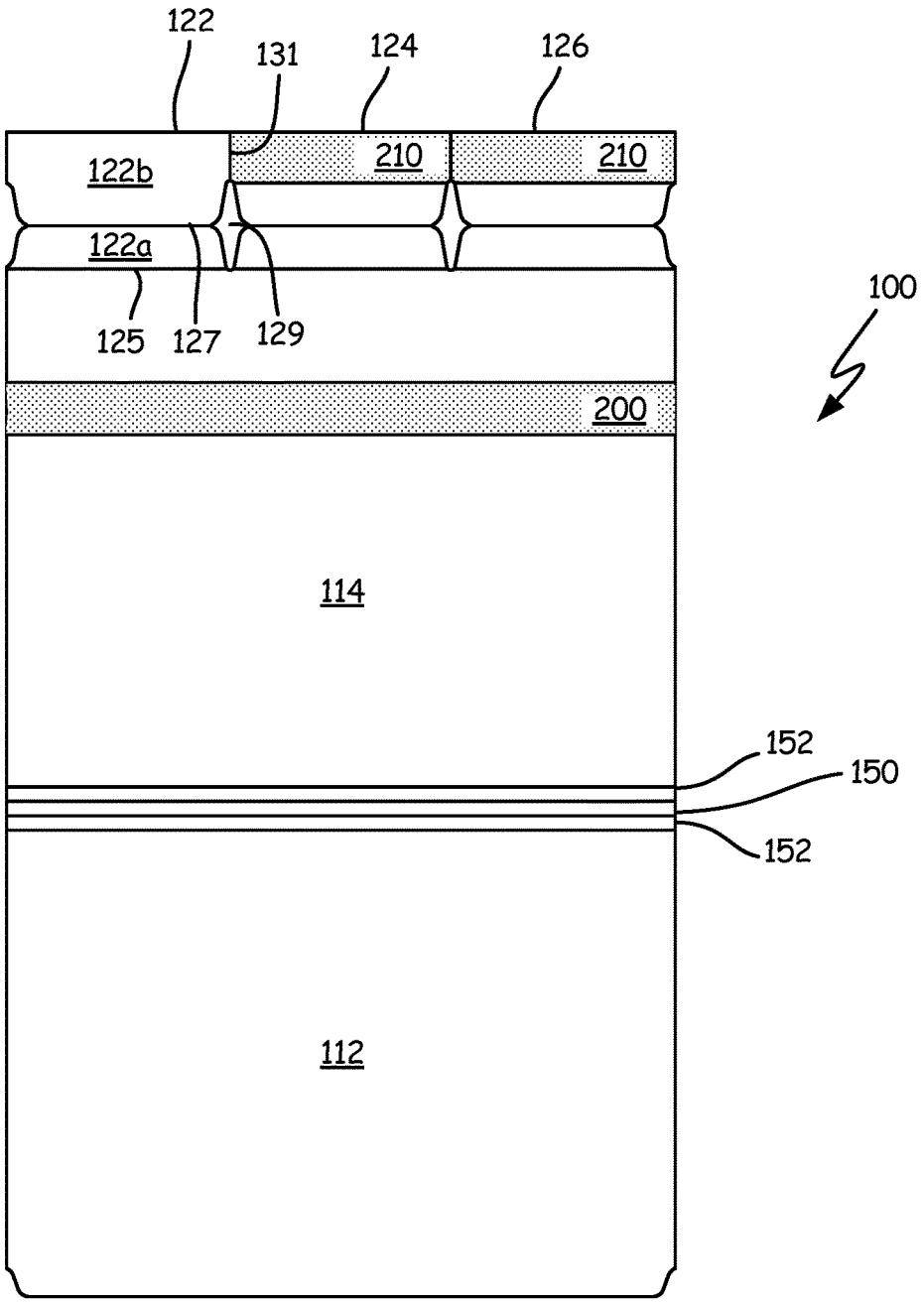
FIG. 3 is a top plan view of a folder blank web cut to have integrated selectable tabs.

In FIG. 3, a folder blank 100 is preferably cut or punched to have the multiple elements. Folder 100 has a front panel 112, back panel 114, a center fold/score line 150 and preferably a plurality of folds/scores 152 parallel to fold 150, which provide expansion space within the spaced defined between front and rear panels.

At a distal end of back panel 114 is a plurality of tab cuts 122, 124, 126. Each of these tab cuts is identical though they can be of different widths, so only one will be discussed in further detail.

Tab 122 includes a first lower portion 122*a* with extends longitudinally from the top edge of panel 114 along a score/fold line 125. Tab 122 also includes an upper portion 122*b* which is joined to portion 122*a* by a score/fold line in 127. Finally a side edge of tab 122 is joined to a like side edge the adjoining tab(s) at score line 131. Score 131 is preferably a breakaway score meaning that it is a deep score or a series of cuts with bridges therebetween. The objective is that the two adjacent upper tab portions can be user separated.

Figure 4:
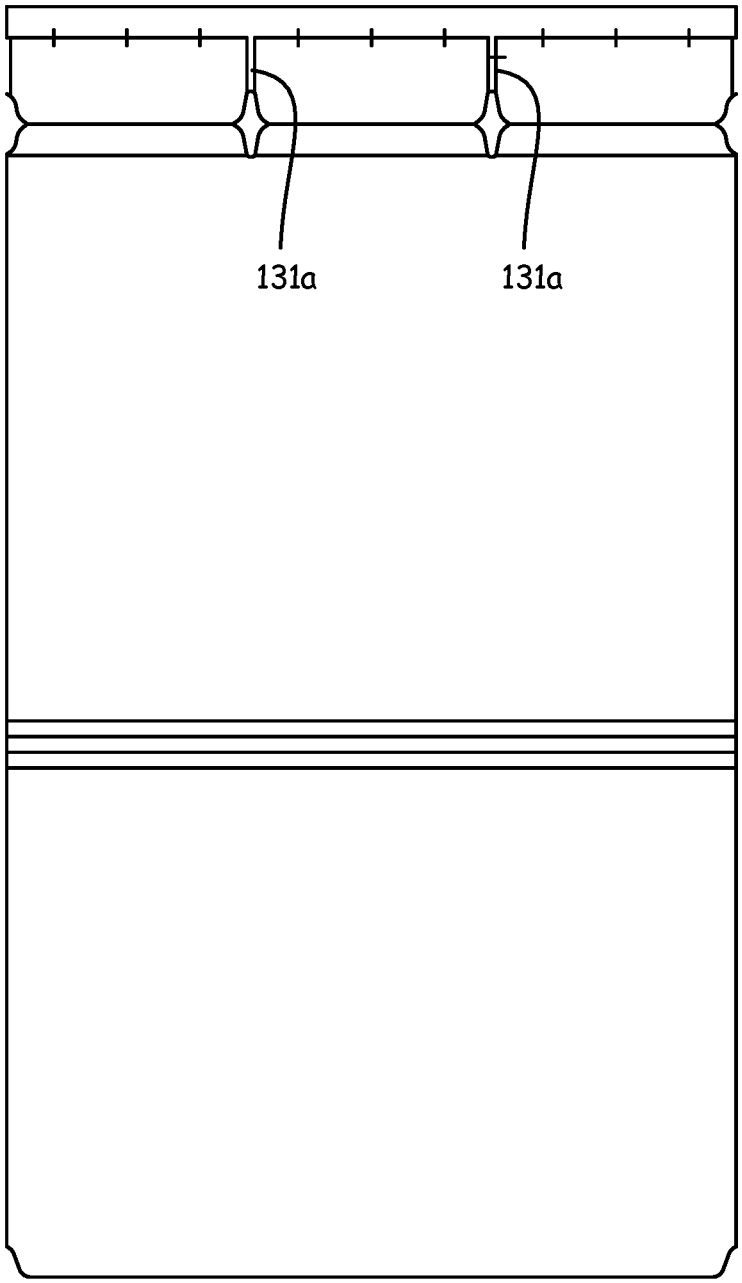
FIG. 4 is a view like FIG. 3 in another embodiment.
Figure 5:
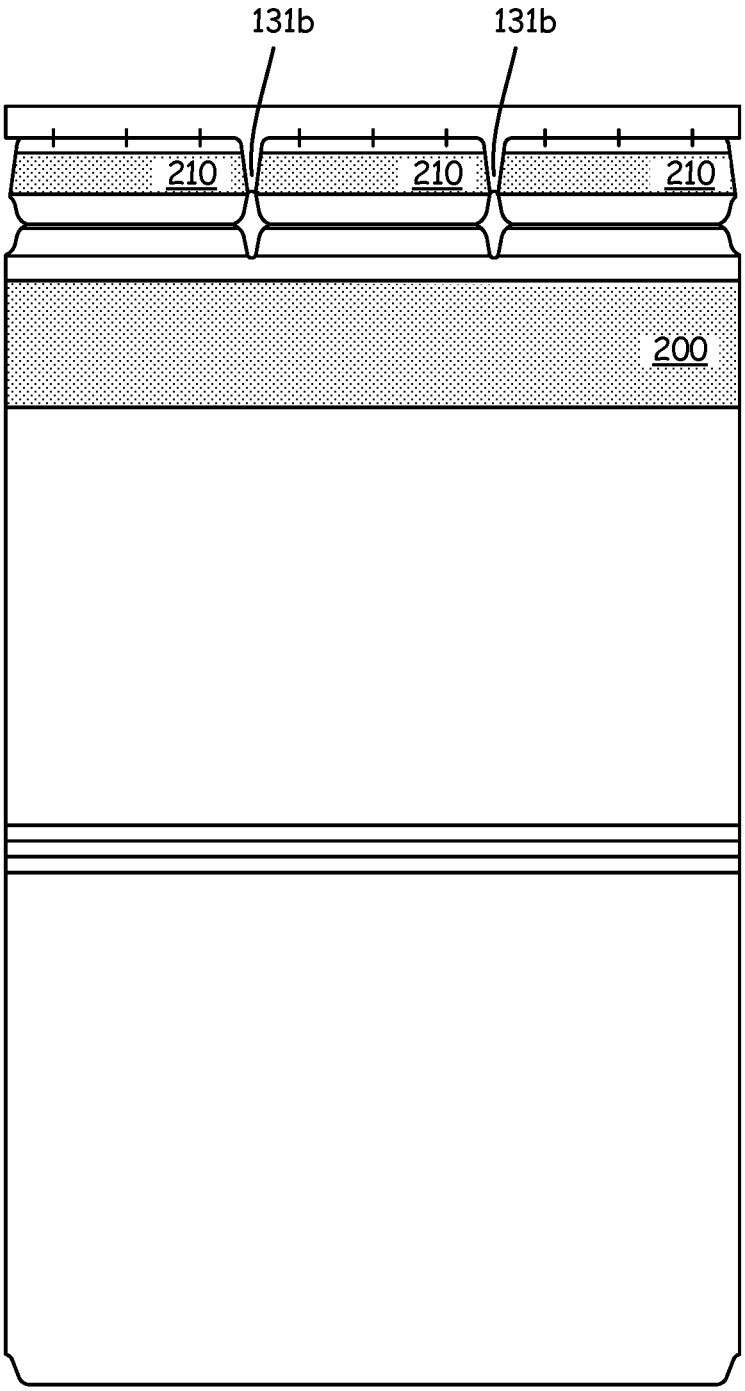
FIG. 5 is a view like FIG. 3 in another embodiment.
Figure 6:
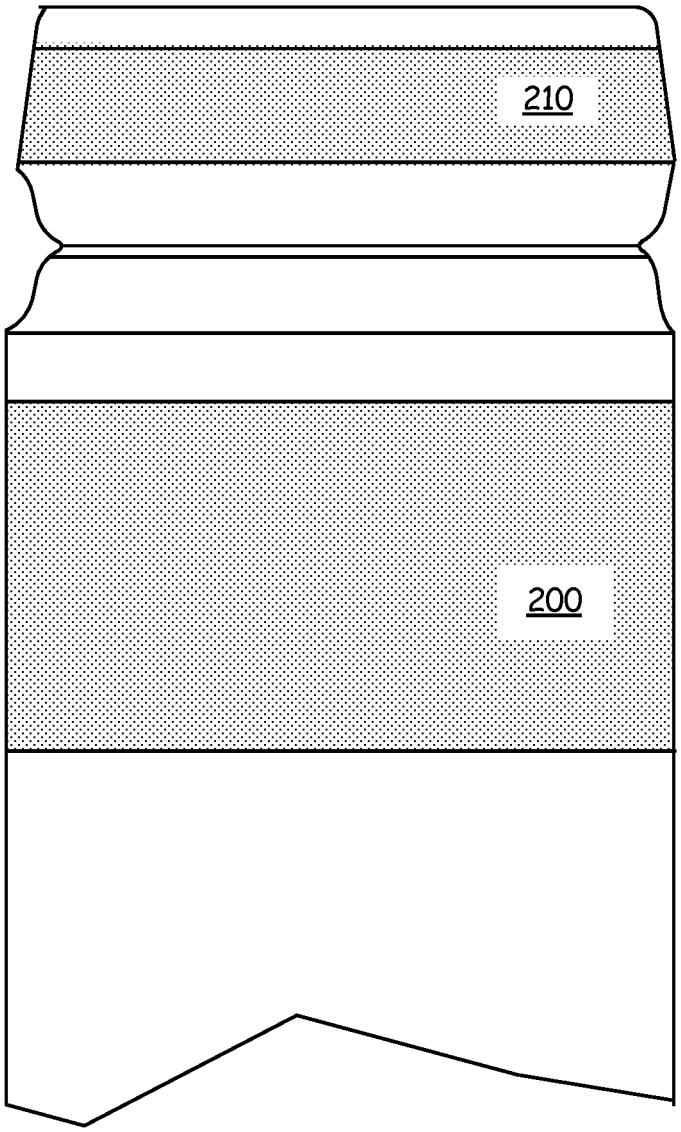
FIG. 6 is a close up plan view of a tab in FIG. 5.

Note of FIGS. 4, 5 and 6 differ from each other with respect to how adjacent tabs are joined. In FIG. 4, the adjacent tabs are separated by a gap 131*a* and not joined but have parallel sidewalls. In FIG. 5, the adjacent tabs are likewise not joined but the gap 131*b* is wider toward the distal end. In other words the tabs are tapered away from each other and never touch. To prevent chaffing between tabs, aperture 129 is formed in between tabs by tapering the lateral edges of adjoining tabs.

In addition to cutting a blank with scoring and separating lines as discussed above, adhesive materials are applied in a band 200 as shown most clearly in FIGS. 5 and 6, an exploded view of one of the tabs. Band 200 is preferably not an adhesive but a smooth surface, preferably a plastic or tape material which has high surface integrity such that it will remain intact when an adhesive tab is separated from it, and not be ripped up or apart from its substrate, or adhere to the adhesive when removed so that the adhesive will be substantially less adhering in a subsequent affixation. An appropriate surface is a carton sealing tape such as Scotch® 3m Carton sealing tape type 375. The adhesive may be a repositionable/refixable adhesive or a low tack refixable tape or smooth tape capable to release, which is solidity affixed to the folder panel and has low tack on its outer surface. It is possible to use a spray on surface treatment/coating instead of a discrete material. This coating must likewise have a low tack adhesion with the tab adhesive so that the tab can be repositioned but also remain affixed in place. A typical Dyne level for the tape id 30-40. The term low tack means that the adhesive is sufficient to bond to the band 200 (also with adhesive) so that the position of the tab is secured, but that a user can lift the tab without destroying the substrate material or the adhesive and reposition it later, typical 4-5 times during the life cycle of the product. Note that band 200 can be of differing widths such as shown in the figures. It only needs to be wide enough to accommodate the various affixations of the tab 210, which will depend according to the tab angle desired. Also note that bands 200 or 210 do not both have to be adhesive. Note that the adhesive are 210 and tack band 200 can be reversed so that the tab are 210 is the low tack surface and the band 200 is the adhesive. A preferred construction is to use a tape/Velcro® for band 200 which provides an easily releasable surface for the tab portion which has an adhesive. This can be reverse, but papers might be attracted to band 200. A tape or protective coating prevents adhesive in the tab portion from ripping the underlying material (often heavy weight stock) and accommodates multiple affixations and releases without damage. Tape or a smooth material also resists accumulation of debris which would lessen the reaffixation of the adhesive coated surface.

To reduce possible memory effect of the score lines which become hinges, the grain of the material (if a fiber material such as paper) should run in the same direction as the score line. Another possible way to reduce memory effect is to make two or three adjacent score lines in place of a single line. With three lines, the central line is where the fold takes place and the two parallel adjacent lines reduce the memory effect in the material Similarly, the tabs themselves have an adhesive or glue, which may be low tack (again when the two adhesive surfaces are considered joined together, in the region 122*b* of each tab (FIG. 3), and preferably not in region 122*a*, though in another embodiment that is permitted. In the preferred embodiment, only the upper portion of region 122*b* is covered with adhesive or adhesive material/tape. The upper portion can be one half, one third, two thirds or other percentage between 1-100% with less coverage needed for higher tack materials. The width of tape area band 200 is dictated by insuring that when the tabs are selectively folded onto panel 114, that the portion of the tab which is covered with adhesive, typically 122*b*, will engage the light tack adhesive band on panel 114.

Figure 7:
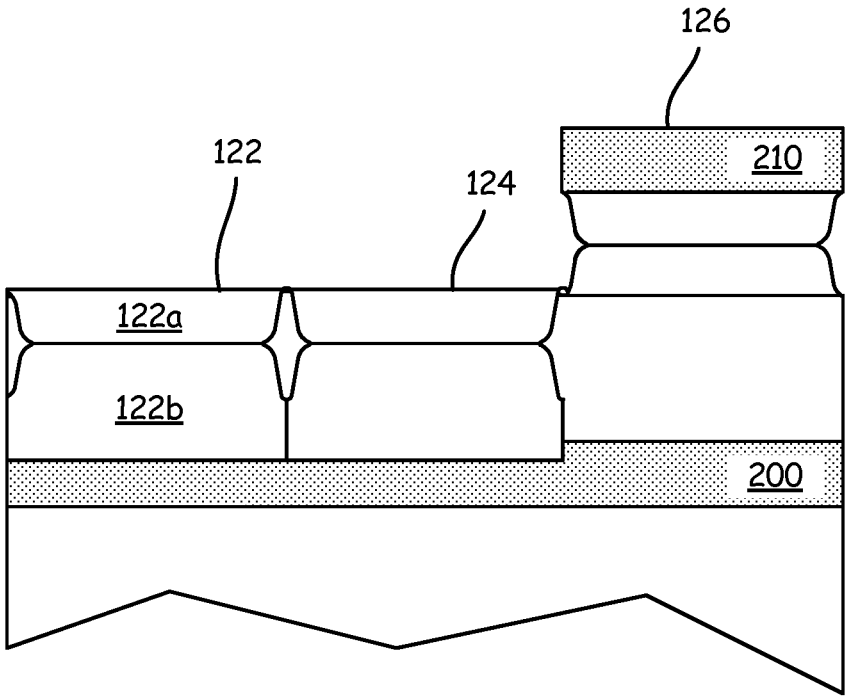
FIG. 7 is partial plan view of a folder showing one tab selected and open.

The operation of the selective foldability of tabs is shown in FIGS. 7-10. In FIG. 7, the rightmost tab 126 has been selected as the "visible" tab while the remaining tabs 122, 124, that are shown folded into a "non-visible" position. The visible position means that when folders are aligned front to back, such as in a file drawer, the non-visible position, i.e. below or equal to the upper panel edge of the front folder panel. Visible tabs are those that rise above the upper panel edge of the front folder panel so that they are visible to use.

FIG. 7 illustrates the rightmost tab having been separated from its adjacent tab by breaking a joint therebetween, in those embodiments where the tab is joined. Tabs 122 and 124 are shown folded flat with the tack surfaces of the tab and patent in releasable engagement. Releasable engagement means that the folded tab can be released from the band adhesive 200. This releasability of the tabs allows the user to selective change which tab or tabs may be folded as visible or invisible. Notice that the tab faces can be made back to back 122*a*/122*b* or at angles relative to each other (for example 122*a* orthogonal to the back panel area 200) or any another angle to create triangular tab of 122*b*, 122*a* and the back panel, by selectively moving the point of adherence between 122*b* and surface 200. This can therefore provide tabs which have planar writing surfaces which are viewable.

Figure 8:
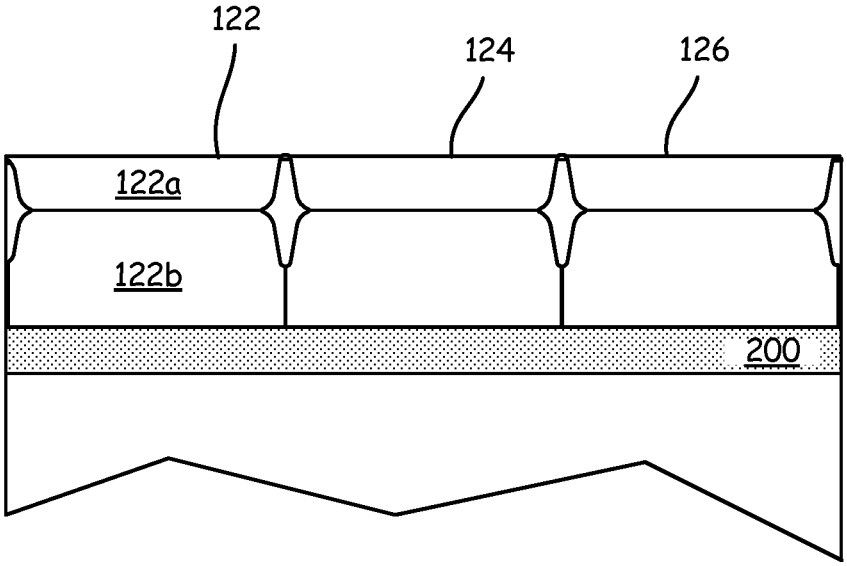
FIG. 8 is a partial plan view of the folder with no tabs selected or open.

FIG. 8 illustrates an arrangement where all three tabs 122, 124, 126 are folded into their visible position. This is the likely way the product should be offered for sale. The user may move one or more tabs to its "non-display" position (i.e. not visible over the top edge of the folder).

Figure 9:
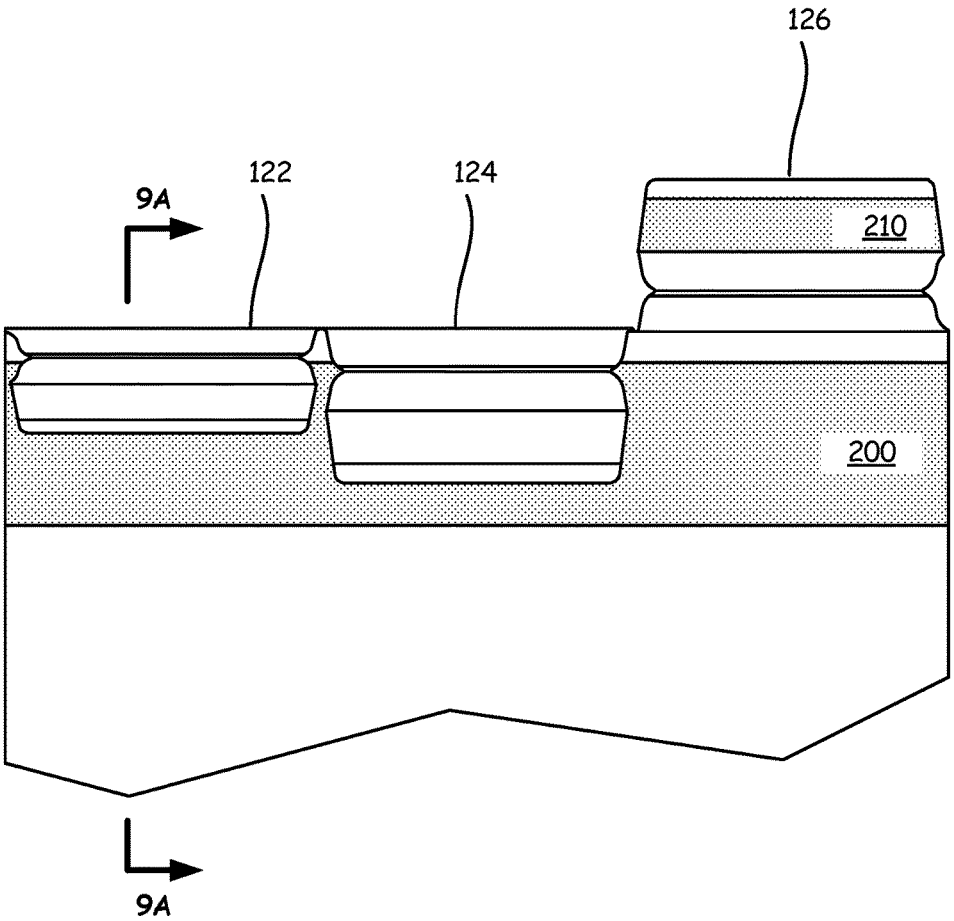
FIG. 9 is partial plan view of a folder showing one tab selected and positioning in a 45 degree viewing angle.
Figure 9A:
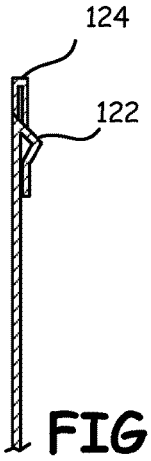
FIG. 9A is a side plan view taken along lines 9A-9A of FIG. 9.

FIG. 9 illustrated a user selected single tab for visibility with the remaining tabs being invisible/out of view. The single tab shown is displayed at an 45 degree angle, as shown in the side view FIG. 9A. This angle is user selectable.

Figure 10:
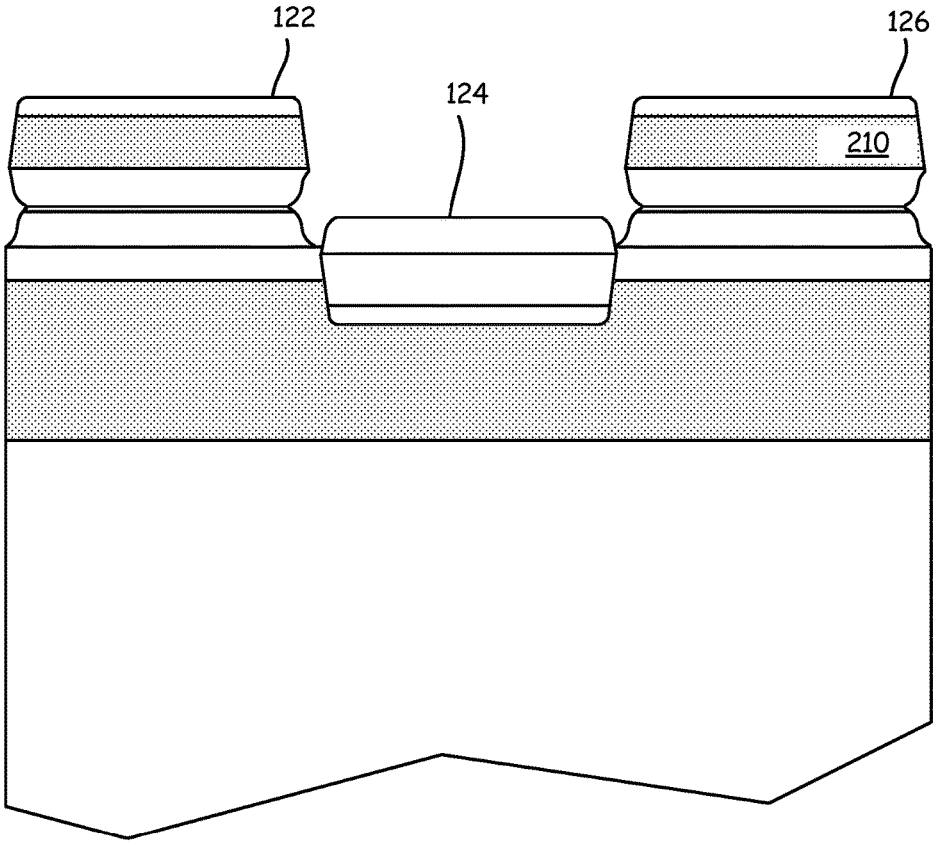
FIG. 10 is partial plan view of a folder showing one tab selected and positioning in an orthogonal viewing position affixed to the back panel of the folder.

FIG. 10 shows the center tab 124 folded for visibility with the remaining tabs in partially folded states.

Note that it is possible to affix the tabs in a manner which creates a three dimensional table rather than a 2D or flat tab as shown in FIGS. 7, 8 and 10. This is accomplished by affixing portion 122*b* so higher on the folder panel 114, so that region 122*a* is angular with respect to panel 114. By this slight change in affixation, region 112*a* can be viewed at an angle rather than merely originally to panel 114. See FIGS. 9, 9A. Note, that it is easily possible to make a three dimensional tab by affixing portion 122*b* higher on the adhesive section 200 so that portion 122*a* is at an angle with respect to 122*b*, such as roughly 35-50 or 45 degrees. This will make the tab viewable from the top and sides.

Figure 11:
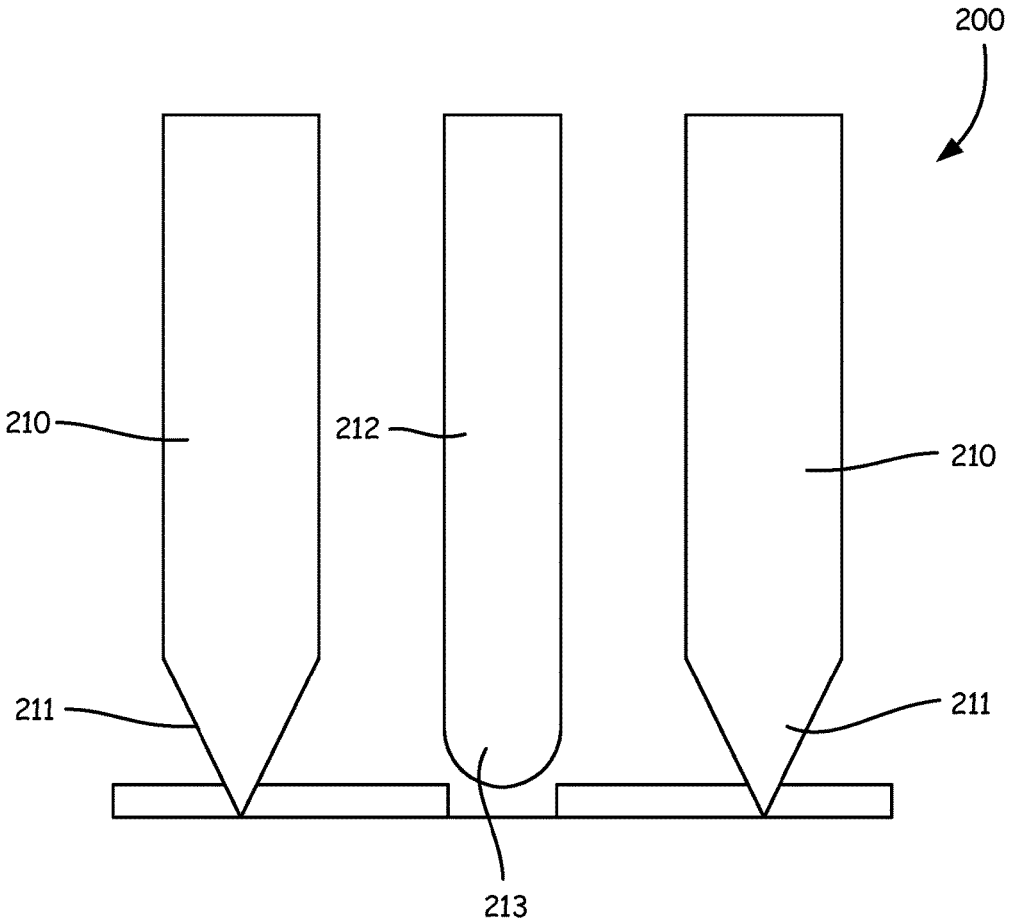
FIG. 11 is a sectional view of a scoring tool.

FIG. 11 illustrates a set of three scoring bar/tools 200 which include a central tool 212 and two tools 210 on either side thereof. The figure shows an end section but the tools are preferably longitudinal bars long enough to score across an entire face or tab in one impression. The tips of the tools vary according to location. Tool 210 has a pointed tip 211 at a preferred tip angle of approximately 52 degrees. The tip 213 on the central score bar 212 is generally radiused/rounded whereas the other bars are pointed. The preferred radius of the rounded tip is approximately 0.042 inch (1.06 mm). All scores on all material are preferably accomplished at the same time by adjusting the spacing between score bars. The purpose of having multiple score bars parallel but spaced part is to limit the memory effect of folded stock. It is desirable to have the stock stay folded so that amount of adhesive required to hold the tab in place, is reduced. Making a sharper strike on the score bar on either side of the more rounded tip has that effect by breaking down the fibers or compressing the thickness adjacent the central score line.

A method of making a file folder is also disclosed according to the above description where a blank is cut as explained above, scoring is applied, and then tape or adhesive as explained above.

Also disclosed is a method of reducing the memory effect in fibrous material at score lines. The method can include any or all of the following steps in any order:

a method of minimizing memory effect at a fold line when at least one tab folded comprising the steps of:

a. defining a place folding line in said stock;
b. impressing first compression recess in said stock along the fold line by a first scoring tool of first predetermined force having a rounded tip;
c. impressing a pair of parallel lines on either side of said fold line but spaced apart therefrom by a second scoring tool of a second predetermined force, said second scoring tool have a tip less rounded and more pointed than said first tool, thereby creating three score lines.

The second scoring tool may have a top with an apex.

The second scoring tool may apply a greater force per unit area than said first tool.

The description of the invention and its applications as set forth herein is illustrative and is not intended to limit the scope of the invention. Variations and modifications of the embodiments disclosed herein are possible and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. A file folder having user selectable indictor tabs, comprising:

a) a front panel having a top and bottom edge,
b) a rear panel having, front face, a top and bottom edge,
c) a bottom panel joining said front and rear panels,
d) a plurality of foldable indicator tabs having a bottom edge, said tabs extending upwardly and attached directly from the bottom edge of the tabs to the top edge of the rear panel, said tabs including:

a first region having a front surface, and top and bottom edges, said top edge foldably extended from said top edge;

a second region having front surface and a top and bottom edges, foldably extended from the top edge of said first region;

said plurality of tabs being adjacent across the top edge of the rear panel;

e) a score folding line between said top edge of said rear panel and the bottom edge of said first region;

f) a score folding line between said top edge of said first region and the bottom edge of said second region;

g) at least a portion of said front surface of second region including an adhesive thereon;

h) at least a portion of said front face of said rear panel being capable of being releasably attached to said adhesive;

so that a user may fold one or more tabs into a user visible position where the second region is folded over the first region and onto at least a portion of the adhesive on said rear panel, whereby that folded tab is at least partly visible over said front panel and where a user may fold the remaining tabs to a visible position or invisible position, said invisible position having said first region folded onto said rear panel.

2. The folder of claim 1 wherein said plurality of tabs are joined to each other with a breakable bridge.

3. The folder of claim 1 wherein the plurality of tabs are spaced apart from each other.

4. The folder of claim 1 wherein said score folding lines include a plurality of adjacent parallel impressions to remove tension in the folding lines.

5. The folder of claim 1 wherein said score folding lines include a central score line having a generally rounded impression and a pair of adjacent score lines on either side of said central score line which have sharper impressions than said central score line.

6. The folder of claim 1 wherein said adhesive on said rear panel and said second region removably join said region to said panel.

7. The folder of claim 6 wherein said adhesive, when brought together with the surface it can be separated without damage to the second region and read panel.

8. The folder of claim 6 wherein said adhesive is a low tack with respect to separation.

9. The folder of claim 6 wherein said adhesive can be separated multiple times without damage to said region and panel.

10. The folder of claim 1 wherein at least one of the adhesives is a tape.

11. The folder of claim 1 wherein said folder is made from a fibrous stock and wherein the fibers generally run in one direction, and wherein said score lines are oriented to generally align with the direction of the fibers to minimize memory effect of at the score lines.

12. The folder of claim 1 wherein the plurality of tabs are spaced apart from each other at their side edges and wherein their side edges are tapered away from each other to minimize memory effect.

13. The folder of claim 1 where in the adhesive force between the second region including an adhesive and said front face of said rear panel is generally 30-40 Dyne.

14. A tabbed divider having user selectable indictor tabs, comprising:

a single sheet of material cut into a unitary sheet with following unitary elements:

a) a panel having, front face, a top and bottom edge, b) a plurality of foldable indicator tabs being unitary with said panel and extending upwardly from the top edge of the panel, said tabs including:

a first region having a front surface, and top and bottom edges, said top edge foldably extended from said top edge;

a second region having front surface and a top and bottom edges, foldably extended from the top edge of said first region;

said plurality of tabs being adjacent across the top edge of the panel;

c) a score folding line between said top edge of said panel and the bottom edge of said first region;

d) a score folding line between said top edge of said first region and the bottom edge of said second region;

e) at least a portion of said front surface of second region including a low tack adhesive thereon;

f) at least a portion of said front face of said panel including a high integrity surface capable of remaining intact after removal of said portion including an adhesive;

so that a user may fold one or more tabs into a user visible position where the second region is folded over the first region and onto at least a portion of the adhesive on said panel, whereby that folded tab is at least partly visible and where a user may fold the remaining tabs to a visible position or invisible position, said invisible position having said first region folded onto said panel.

15. The folder of claim 14 wherein said plurality of tabs are joined to each other with a breakable bridge.

16. A file folder having user selectable indictor tabs, comprising:

a single sheet of material cut into a unitary sheet with following unitary elements:

a) a front panel having a top and bottom edge, b) a rear panel having, front face, a top and bottom edge, c) a bottom panel being unitary with and joining said front and rear panels, d) a plurality of foldable indicator tabs being unitary with and extending from the top edge of the rear panel, said tabs including:

a first region having a front surface, and top and bottom edges, said top edge foldably extended from said top edge;

a second region having front surface and a top and bottom edges, foldably extended from the top edge of said first region;

said plurality of tabs being adjacent across the top edge of the rear panel;

e) a score folding line between said top edge of said rear panel and the bottom edge of said first region;

f) a score folding line between said top edge of said first region and the bottom edge of said second region;

g) at least a portion of said front surface of second region including an adhesive thereon;

h) at least a portion of said front face of said rear panel being capable of being releasably attached to said adhesive;

so that a user may fold one or more tabs into a user visible position where the second region is folded over the first region and onto at least a portion of the adhesive on said rear panel, whereby that folded tab is at least partly visible over said front panel and where a user may fold the remaining tabs to a visible position or invisible position, said invisible position having said first region folded onto said rear panel.

17. The folder of claim 16 wherein said plurality of tabs are joined to each other with a breakable bridge.

* * * * *